US010501959B2

(12) United States Patent
Beard

(10) Patent No.: US 10,501,959 B2
(45) Date of Patent: Dec. 10, 2019

(54) CHRISTMAS TREE TENT

(71) Applicant: Emily Frances Harper Beard, Nashville, TN (US)

(72) Inventor: Emily Frances Harper Beard, Nashville, TN (US)

( * ) Notice: Subject to any disclaimer, the term of this patent is extended or adjusted under 35 U.S.C. 154(b) by 0 days.

(21) Appl. No.: 16/252,691

(22) Filed: Jan. 20, 2019

(65) Prior Publication Data

US 2019/0226227 A1 Jul. 25, 2019

Related U.S. Application Data

(60) Provisional application No. 62/709,525, filed on Jan. 22, 2018.

(51) Int. Cl.

| | |
|---|---|
| ***E04H 15/24*** | (2006.01) |
| ***E04H 15/54*** | (2006.01) |
| ***E04H 15/10*** | (2006.01) |
| *E04H 15/56* | (2006.01) |

(52) U.S. Cl.

CPC ..... *E04H 15/24* (2013.01); *E04H 15/10* (2013.01); *E04H 15/54* (2013.01); *E04H 15/56* (2013.01)

(58) Field of Classification Search

CPC ..... E04H 15/24; E04H 15/54

USPC ..... 135/100

See application file for complete search history.

(56) References Cited

U.S. PATENT DOCUMENTS

| | | | | | |
|---|---|---|---|---|---|
| 1,415,482 | A * | 5/1922 | Reed | E04H 15/006 | 135/100 |
| 1,599,213 | A * | 9/1926 | Coupal | E04H 15/24 | 135/100 |
| 1,672,306 | A * | 6/1928 | Coupal | E04H 15/00 | 135/100 |
| 1,995,489 | A * | 3/1935 | Valasck | E04H 15/24 | 135/120.3 |
| 2,755,009 | A * | 7/1956 | Parker | E04H 15/00 | 182/129 |
| 2,926,676 | A * | 3/1960 | Kleinau | E04H 15/24 | 135/100 |
| 3,406,698 | A | 10/1968 | Hutchison | | |
| 4,838,292 | A | 6/1989 | Allen | | |
| 4,838,293 | A * | 6/1989 | Novak | E04H 15/24 | 135/100 |
| D313,830 | S | 1/1991 | Foust | | |
| 5,439,018 | A * | 8/1995 | Tsai | E04H 15/40 | 135/100 |
| D412,959 | S | 8/1999 | Cung | | |
| 6,168,495 | B1 * | 1/2001 | Yoon | A63H 33/008 | 446/476 |

(Continued)

FOREIGN PATENT DOCUMENTS

WO WO-2017129241 A1 * 8/2017 ..... A63H 33/008

*Primary Examiner* — Noah Chandler Hawk

(74) *Attorney, Agent, or Firm* — James L Farmer

(57) ABSTRACT

Provided is a method and apparatus for a Christmas tree tent. The tent includes a conical shaped fabric cover with a wide base, a pointed top, an inside, and an outside. A plurality of evenly spaced side poles extend from the base to the top of the cover, and together with the cover define a teepee shaped tent having corners and sides. One of the sides is a front side with an opening for tent ingress and egress. The tent may further include a plurality of buttons affixed to the outside, and a plurality of removable fabric ornaments, each with a cord loop for hanging the ornaments on the buttons.

14 Claims, 5 Drawing Sheets

(56) References Cited

U.S. PATENT DOCUMENTS

| | | | | |
|---|---|---|---|---|
| 6,752,164 | B1 | 6/2004 | Park | |
| 7,211,305 | B2 * | 5/2007 | Steiger | A41G 1/001 283/100 |
| 8,708,765 | B2 | 4/2014 | Pope-Gusev | |
| 8,826,927 | B1 * | 9/2014 | Beam | E04H 15/001 135/115 |
| 10,021,943 | B2 * | 7/2018 | Ferris | A44B 1/04 |
| 2009/0036017 | A1 * | 2/2009 | Leleu | A63J 19/00 446/82 |

* cited by examiner (Section A-A)

CHRISTMAS TREE TENT

TECHNICAL FIELD AND BACKGROUND

The technical field of the present invention relates to tents, and may more specifically relate to fabric tents supported by rigid poles.

DESCRIPTION OF THE EMBODIMENTS

Figure 1:
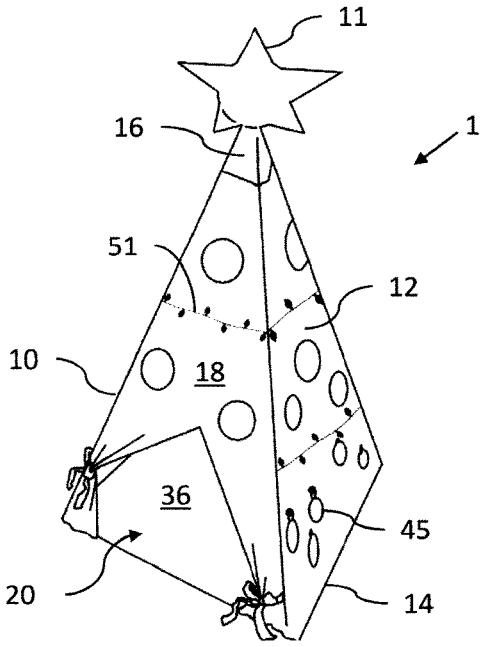
FIG. 1 is top perspective view of a Christmas tree tent in accordance with the present disclosure.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now to the drawing figures, an interactive Christmas tree tent is disclosed and indicated generally at reference numeral 1. The Christmas tree tent is intended to provide a fun alternative or addition to a traditional Christmas tree for families with babies and/or toddlers. The Christmas tree tent shares a similar basic shape and structure with a standard tent or tee-pee, however it is designed to look like a Christmas tree with certain unique interactive components for families who want the joy of Christmas in their home without the trouble of worrying about potential dangers associated with a conventional decorated tree.

Referring initially to FIGS. 1 through 5, the interactive Christmas tree play tent 1 may comprise a conical, or teepee shaped fabric cover 10 supported by a frame 31. The frame may comprise a series of regularly arranged side poles 33 extending from a base to a top of the tent such that the cover and side poles together define a teepee shape with sides and corners. In the depicted embodiment there are four triangular shaped sides 12 to the cover and tent, each side extending from a wide bottom edge 14 at the base to an apex 16 at the top. The frame may further include floor poles 35 extending between the bottom ends of side poles 33. The side and floor poles may be made of any generally rigid material, such as for example wood, metal, or fiberglass.

The cover 10 may be generally triangular shaped panels stitched together to give the teepee, or Christmas tree shape, with side poles 33 positioned at the seams (corners) between panels. In one embodiment the cover is made of green cotton felt.

Figure 6:
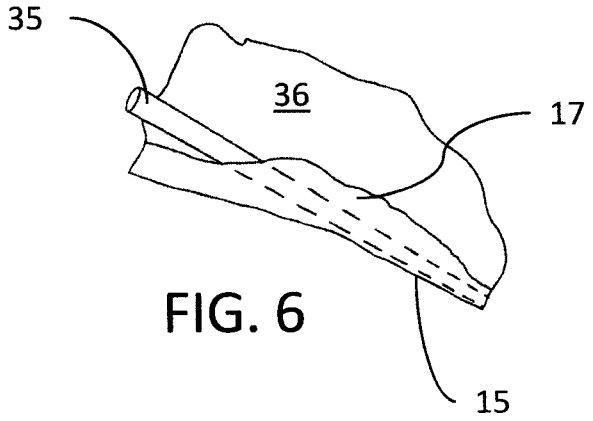
FIG. 6 is a close up view of a floor pole received in a hem along a front edge of the tent floor.

One of the sides 12 of tent 1 is a front side 18 with an opening 20 for tent ingress and egress. Opening 20 may be in the form of a slit 21 (see particularly FIG. 4) in the cover extending upward from the base edge 14 to define flaps 23, with sashes 25 attached to the cover for holding the flaps open, as shown for example in FIG. 2. A fabric floor 36 is stitched, or otherwise contiguously affixed to the bottom edges 14 of the sides 12 of the cover, except for along the front 18 in order to allow for pulling back the flaps 23. The floor thus has a free edge 15 under flaps 23. In one embodiment shown in FIG. 6, the free edge 15 has a fold or stitched hem 17 for receiving the front floor pole 35 to help prevent the floor from sliding back into the tent.

In the depicted embodiment the floor 36 is a square, and the tent has four side poles 33 delineating four sides 12, including the front side 18, and a back side 13 opposite the front side. Alternatively, the tent can have more than four side poles 33 and sides 12, giving the tent for example a hexagonal or octagonal shape, with a corresponding hexagonal or octagonal shaped floor 36. The floor poles 35 may be straight as depicted, or arcuate forming a circle.

Figure 7:
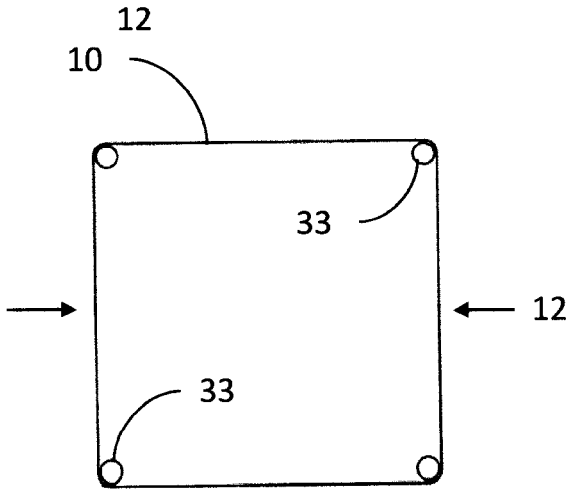
FIG. 7 is a cross-section view through the Christmas tree tent at section A-A indicated on FIG. 2.
Figure 8:
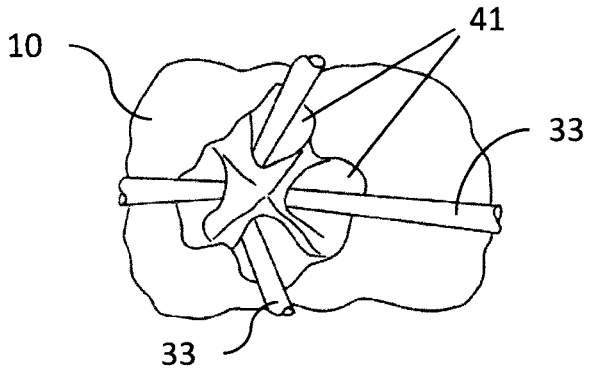
FIG. 8 is a view from inside the tent looking up showing the upper ends of the side poles secured in pockets.

Referring now also to the cross-section view of FIG. 7, the side poles 33 may support the cover 10 from the inside as shown. In one embodiment the frame is a contiguous interconnected structure with the side poles 33 all joined together at the top, and with the side and floor poles joined together at the bottom. In such an embodiment the cover 10 may be simply draped over the frame 31. Alternatively, the poles may be configured to support the cover by fitting the ends of the poles into pockets sewn into the cover. In one such embodiment shown in FIG. 8, ends of the side poles 33 are received in pockets 41 on the inside of cover 10 at the top of the tent. In any case the tent can be configured to have the cover 10 be somewhat loose, or stretched tight by the frame as desired.

Figure 9:
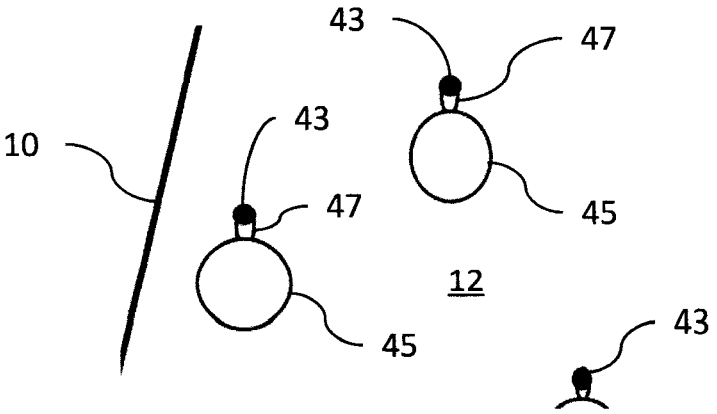
FIG. 9 is a close-up view of a portion of a side of the Christmas tree tent showing the buttons and removable fabric ornaments.

Referring now to FIG. 9, the tent 1 may include a plurality of buttons 43 distributed around the outside of the cover 10 for hanging a plurality of removable fabric ornaments 45. Buttons 43 may be stitched on, or otherwise permanently attached to the cover. Each of the removeable ornaments 45 is equipped with a cord or ribbon loop 47 for hanging the ornaments on the buttons. The buttons 43 may be positioned at about eye level for a typical toddler, or generally within a toddler's reach, such as within a range of between about one and two feet from the bottom of the tent. In one embodiment buttons 43 are included on all sides 12 of the tent except for the front side 18.

Figure 2:
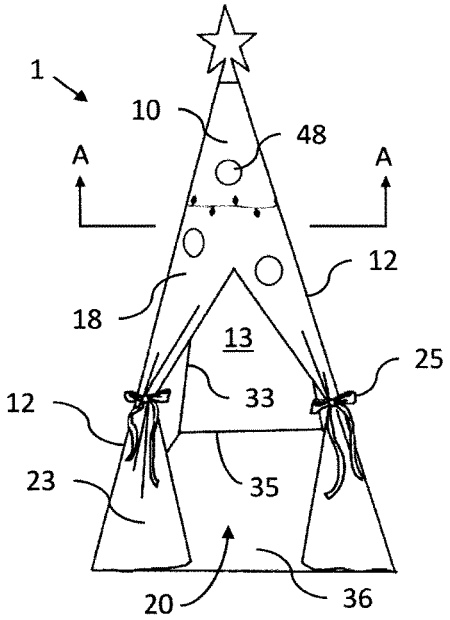
FIG. 2 is a front plan view of the Christmas tree tent of FIG. 1 with the flaps held open.
Figure 3:
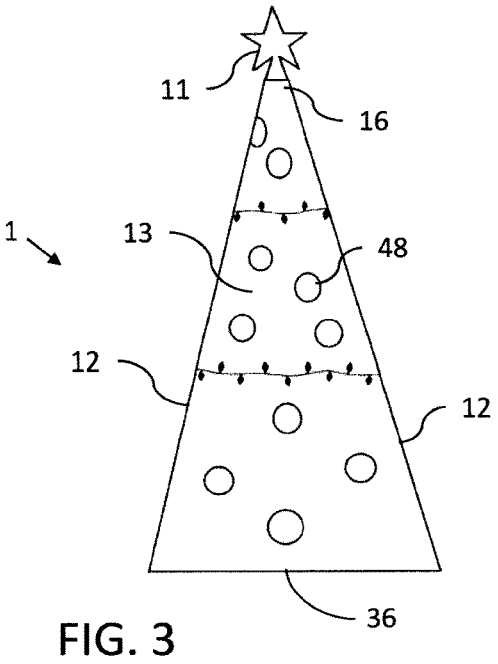
FIG. 3 is a back plan view of the Christmas tree tent of FIG. 1.
Figure 4:
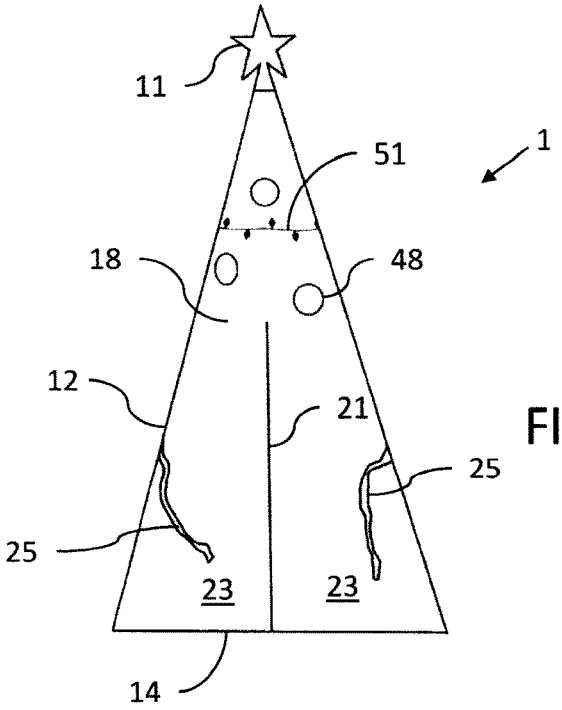
FIG. 4 is a front plan view of the Christmas tree tent with the flaps closed.
Figure 5:
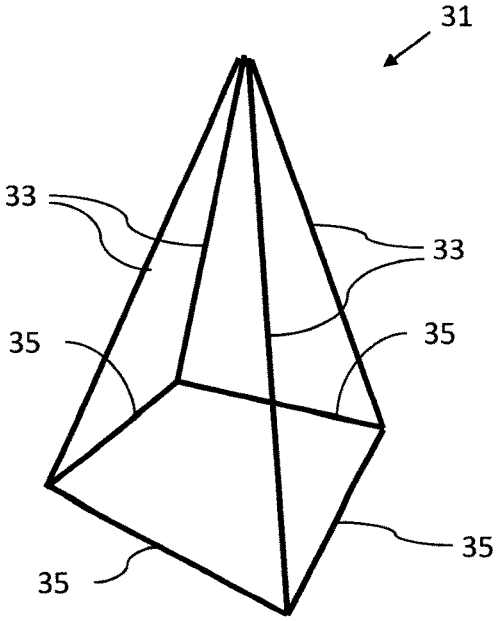
FIG. 5 is a top perspective view of an exemplary frame portion of the Christmas tree tent.

Tent 1 may further include non-removable fabric ornaments 48 and Christmas lights 51 disposed about the outside of cover 10 (see FIGS. 1 through 3). The non-removable fabric ornaments 48 may be simply cut-out fabric shapes with a colorful or decorative appearance that are stitched or glued to the cover. In one embodiment the non-removable fabric ornaments 48 are located generally above, and/or below, the portion of the tent sides with buttons 43.

Figure 10:
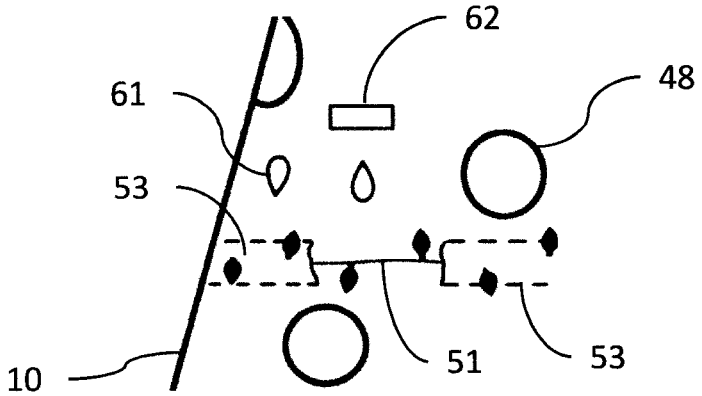
FIG. 10 is a close-up view of another portion of a side of the Christmas tree tent showing a partially cut-away view of a sewn channel for a light string, and examples of glow-in-the-dark paper lights.

The Christmas lights 51 may be a string of conventional electric lights that are wrapped around the outside of the tent, as shown for example in FIG. 1. Alternatively, the cover 10 may include a stitched in tube or channel 53 for receiving a light string, as shown in FIG. 10, that hides the cord while allowing the light bulbs to protrude through holes in the cover. The Christmas lights 51 may alternatively comprise glow-in-the-dark printer paper shapes adhered to the tent, such as for example the paper light shape 61 and the paper strip shape 62 also shown in FIG. 10. Suitable glow-in-the-dark paper products are readily available at stores and online, such as the "Silhouette of America Glow-in-The Dark Printable Sticker Paper" sold on Amazon by Silhouette America.

Figure 11:
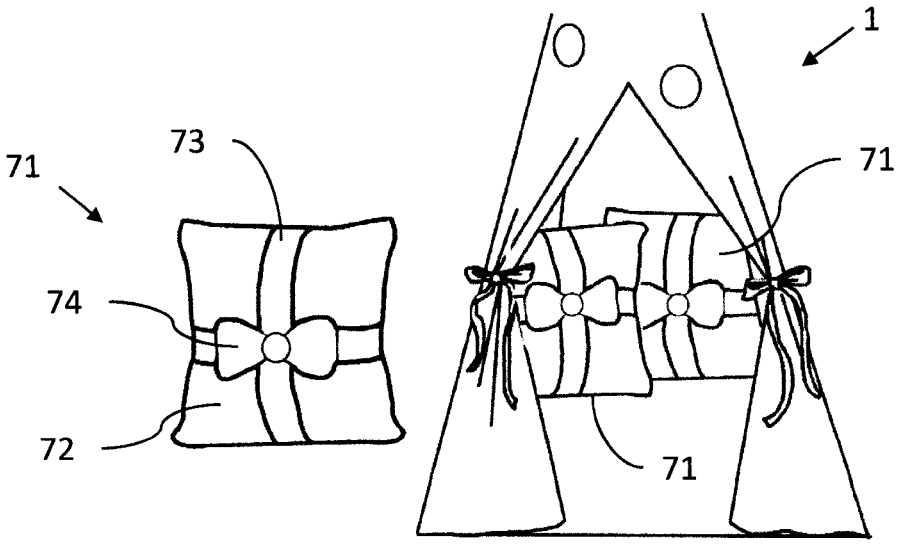
FIG. 11 is a front view of the Christmas tree tent with Christmas package pillows shown inside and outside the tent.

Referring to FIG. 11, the Christmas tree tent may further include one or more rectangular or box shaped pillows 71 for placement inside or around the base of the tent. The pillows 71 are configured to have the appearance of a wrapped Christmas gift, including for example a colorful or Christmas-themed cover 72, one or more decorative ribbons 73 encircling the pillow, and a ribbon bow 74.

The tent may further include a fabric Christmas star 11 stitched to the top. In one embodiment the star 11 is configured as a pillow with two sides and a soft filler material.

The Christmas tree tent of the present disclosure further comprises a method of use. In one embodiment the method involves the following steps for providing a safe Christmas tree experience for a toddler:

1. providing a conical shaped fabric cover with a wide base and a generally pointed top;

2. supporting the cover with a plurality of evenly spaced side poles extending from the base to the top of the cover, where the side poles and cover together define a teepee shaped tent having corners and sides, and where one of the sides is a front side with an opening for tent ingress and egress;

3. attaching a plurality of buttons to an outside of the tent at a level within reach of a toddler; and/or 4. hanging a plurality of decorative fabric ornaments from the buttons using a cord loop attached to each ornament.

The above method may further comprise the following additional steps:

5. creating a tent frame by connecting the bottom ends of the side poles with floor poles and joining together the upper ends of the side poles;

6. attaching a fabric floor to the tent along bottom edges of the cover sides; wherein the buttons are between one and two feet from the bottom edges of the sides;

7. illuminating the outside of the tent with lights;

8. attaching a plurality of non-removable fabric ornaments to an outside of the tent above the area with the buttons and removable ornaments; and/or 9. providing four side poles, giving the tent four corners and four sides.

There has been described a novel christmas tree tent apparatus and process. For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed is:

1. An interactive Christmas tree play tent, comprising:

a teepee shaped fabric cover having at least four triangular shaped sides, each side extending from a wide bottom edge at a base of the tent to an apex at a top of the tent, wherein one of the sides is a front side with an opening for tent ingress and egress;

a fabric floor having edges attached contiguously to the bottom edges of each side of the cover except for the front side of the cover;

a frame supporting the cover comprising a plurality of side poles extending from the base to the top of the tent at junctures between adjacent cover sides, and a plurality of base poles extending between bottom ends of the side poles;

a plurality of decorative lights made of glow-in-the-dark paper disposed about the outside of the cover, a plurality of buttons affixed to an outside of the tent; and a plurality of removable fabric ornaments, each with a cord loop for hanging the ornaments on the buttons.

2. The interactive Christmas tree play tent of claim 1, wherein the buttons are located at a height between approximately one and two feet from the base of the tent.

3. The interactive Christmas tree play tent of claim 1, wherein the opening is a slit extending up from the bottom edge of the front side of the cover creating two flaps.

4. The interactive Christmas tree play tent of claim 3, further comprising fabric sashes configured to hold the flaps open.

5. The interactive Christmas tree play tent of claim 1, further comprising a plurality of non-removable decorative fabric ornaments permanently attached to the outside of the cover.

6. The interactive Christmas tree play tent of claim 1, further comprising a fabric star stitched to the top of the tent.

7. The interactive Christmas tree play tent of claim 1, wherein the cover is green felt.

8. The interactive Christmas tree play tent of claim 1, wherein the side and base poles are fiberglass.

9. A method of providing a safe Christmas tree experience for a toddler, comprising the steps of:

providing a conical shaped fabric cover with a wide base and a pointed top;

supporting the cover with a plurality of evenly spaced side poles extending from the base to the top of the cover, the side poles and cover together defining a teepee shaped tent having corners and sides, wherein one of the sides is a front side with an opening for tent ingress and egress;

attaching a plurality of buttons to an outside of the tent; and hanging a plurality of decorative fabric ornaments from the buttons using a cord loop attached to each ornament.

10. The method of claim 9, further comprising the steps of:

creating a tent frame by connecting bottom ends of the side poles with floor poles; and attaching a fabric floor to the cover along bottom edges of the tent sides.

11. The method of claim 9, wherein the buttons are between one and two feet from the bottom edges of the tent sides.

12. The method of claim 9, further comprising the step of illuminating an outside of the tent with lights.

13. The method of claim 11, wherein the cover further comprises a plurality of non-removable fabric ornaments attached to an outside of the tent more than two feet from the cover base.

14. The method of claim 9, wherein there are four side poles giving the tent four corners and four sides.

* * * * *